US005283500A

United States Patent [19]

Kochanski

[11] Patent Number: 5,283,500

[45] Date of Patent: Feb. 1, 1994

[54] FLAT PANEL FIELD EMISSION DISPLAY APPARATUS

[75] Inventor: Gregory P. Kochanski, Dunellen, N.J.

[73] Assignee: AT&T Bell Laboratories, Murray Hill, N.J.

[21] Appl. No.: 889,735

[22] Filed: May 28, 1992

[51] Int. Cl.[5] ..... H01J 7/44

[52] U.S. Cl. ..... 315/58; 315/169.3; 315/169.1; 315/349; 313/336; 313/309; 313/306

[58] Field of Search ..... 315/169.4, 169.3, 169.1, 315/324, 349; 313/309, 308, 307, 306, 336, 351; 340/766, 775, 782, 718

[56] References Cited

U.S. PATENT DOCUMENTS 4,884,010 11/1989 Biberian ..... 313/309
4,940,916 7/1990 Borel et al. ..... 313/306

OTHER PUBLICATIONS

*Semiconductor International,* Dec. 1991, p. 11.
"Field-Emitter Arrays Applied to Vacuum Fluorescent Display", by C. A. Spindt et al., IEEE Transactions on Electron Devices, vol. 36, No. 1, Jan. 1989, pp. 225-228.
"Field Emitter Arrays—More Than a Scientific Curosity?", by H. F. Gray, Colloque de Physique, Colloque C8, supplement au No. 11, Tome 50, Nov. 1989, pp. C8-67-C8-72.
"Microtips" Fluorescent Display, by P. Vaudaine et al., *IEEE IEDM,* 1991, pp. 197-200.
"Recent Development on 'Microtips' Display at Leti", by R. Meyer et al., Technical Digest of IVMC 91, Nagahama, 1991, pp. 6-9.
"13.7 Microtips Fluorescent Display", by R. Meyer et al., *Japan Display,* '86, 4 pages.
"21.1: Microtips Displays Addressing", by T. Leroux et al., LETI-DOPT-SCMM, Grenoble, France, SID 91 Digest. 3 pages.
"6" Diagonal Microtips Fluorescent Display for T.V. Applications , by R. Meyer, LETI/DOPT CENG, 85×38041 Grenoble Cedex France, 4 pages. Jul., 1990.
"A Thin-Film Field-Emission Cathode", by C. A. Spindt, Applied Physics Laboratory, Stanford Research Institute, Menlo Park, Calif., *Communications,* pp. 3504-3505, Feb. 1968.
"Vacuum Integrated Circuits", by R. Greene et al., Naval Research Laboratory, Washington, D.C. 20375, *IEEE International Electron Devices Meeting,* 85, pp. 172-175.

*Primary Examiner*—Robert J. Pascal
*Assistant Examiner*—J. Dudek
*Attorney, Agent, or Firm*—Eugen E. Pacher

[57] ABSTRACT

The disclosed flat panel field emitter display (FPFED) comprises a first impedance that carries all of the current to all of the micropoint emitters of one or more (preferably one, typically fewer than about five, always fewer than all the pixels of a given row or column of the display) pixels. Provision of the first impedance can provide self-compensation to the involved pixel, making it possible to substantially reduce the required number of micropoint emitters/pixel and color. This in turn can lead to increased speed of the display, and/or to lower power consumption. The first impedance advantageously is a capacitor rather than a resistor, and embodiments that comprise a capacitive first impedance are disclosed. Other advantageous optional features are also disclosed. These include provision of gate impedances, of photoconductive elements, of an auxiliary gate electrode, or of gettering means.

23 Claims, 6 Drawing Sheets

FLAT PANEL FIELD EMISSION DISPLAY APPARATUS

FIELD OF THE INVENTION

This invention pertains to field emission display apparatus.

BACKGROUND OF THE INVENTION

Flat panel field emission displays (FPFEDs) are known. See, for instance, the report on page 11 of the December 1991 issue of *Semiconductor International*. See also C. A. Spindt et al., *IEEE Transactions on Electron Devices*, Vol. 36(1), pp. 225-228, incorporated herein by reference. Briefly, such a display typically comprises a flat vacuum cell with a matrix array of microscopic field emitter cathode tips formed on the back plate of the cell, and a phosphor-coated anode on the front plate of the cell. Between cathode and anode is a third element, frequently referred to as "grid" or "gate".

As is disclosed, for instance, in U.S. Pat. No. 4,940,916 (issued Jul. 10, 1990 to M. Borel et al., for "Electron Source with Micropoint Emissive Cathodes . . . ", incorporated herein by reference), the cathode structure typically comprises a multiplicity of individually addressable conductor strips, and the gate structure similarly comprises a multiplicity of individually addressable conductive strips that are disposed at an angle (typically a right angle) to the cathode conductor strips. Each intersection region defines a display element (pixel). With each pixel is associated a multiplicity of emitters (e.g., $10^2$-$10^3$ emitters/pixel), and associated with each emitter is an aperture through the gate, such that electrons can pass freely from the emitter to the anode. A given pixel is activated by application of an appropriate voltage between the cathode conductor strip and the gate conductor strip whose intersection defines the pixel. Typically a voltage that is more positive with respect to the cathode than the gate voltage is applied to the anode, in order to impart the required relatively high energy (e.g., about 400 eV) to the emitted electrons.

As is also disclosed in the '916 patent, FPFEDs can have a current-limiting resistor (18 of FIG. 3 of '916) in series with each cathode conductor strip. In order to avoid a problem attendant upon such an arrangement (namely, the fact that such FPFEDs frequently contain abnormally bright spots, due to the unavoidable presence of emitter tips of particularly favorable structure), the '916 patent teaches provision of a series resistor $R_i$ for each individual emitter tip, instead of current-limiting resistor 18. This is accomplished by interposition of a resistive layer (5 of FIG. 4 of '916) between the cathode conductor strip and the emitter tips thereon.

However, such an arrangement typically requires that many (e.g., about $10^3$) emitter tips be provided for each pixel, in order to avoid perceptible brightness variation if one or more of the emitter tips fails. This in turn results in relatively high capacitance per pixel, which in turn generally leads to relatively high power consumption.

In view of the considerable economic potential of FPFEDs, it would be highly desirable to have available a FPFED that is free of, or at least less subject to, the above discussed and/or other shortcomings of prior art FPFEDs. This application discloses such a FPFED.

SUMMARY OF THE INVENTION

The invention pertains to articles that comprise a flat panel field emission cathodoluminescent display. In a broad aspect articles according to the invention comprise a multiplicity of generally parallel cathode electrode means, and a multiplicity of gate electrode means, arranged such that the cathode and gate electrode means form a matrix structure that comprises a multiplicity of intersection regions. The cathode electrode means comprise a multiplicity of micropoint emitter means ("micropoints"), and impedance means for limiting the current through the micropoints. In a given intersection region are located a multiplicity (e.g., $>10$ per color) of micropoints. The micropoints face towards the gate electrode means, and with substantially each of the micropoints in the given intersection region is associated an aperture through the gate electrode means. The article further comprises anode means that comprise material capable of cathodoluminescence. The anode means are positioned such that electrons that are emitted from the micropoints in the given intersection region can impinge on the anode means. The article still further comprises means for applying a first voltage $V_1$ between a predetermined cathode electrode means and a given predetermined gate electrode means, and means for applying a second voltage $V_2$ between the predetermined cathode electrode means and the anode means.

Significantly, the above-mentioned impedance means comprise first impedance means that carry substantially all (typically all) of the current associated with substantially all (typically all) of the micropoint emitter means in one or more (typically fewer than five, preferably one) intersection regions, including the given intersection region and including fewer than all of the intersection regions in a column or row.

Frequently FPFEDs according to the invention also comprise second impedance means that comprise a multiplicity of impedances, with a given impedance of said multiplicity carrying the current to one or more (typically fewer than five, but in all cases fewer than all) micropoint emitters of the given intersection region.

The presence of the first impedance that is common to all the micropoints of a pixel can impart the desirable attribute of self-compensation to the given pixel. By this we mean that, in the event of a significant change in the emission characteristics (including high emission, low emission, even open circuit failure) of one or more of the micropoints in the given intersection region, the brightness of the given pixel changes relatively little, because the current to the other micropoints automatically adjusts such that the total brightness remains relatively unchanged. Consequently, fewer micropoints per pixel are needed, making possible lower power consumption and/or higher speed. It will be appreciated that changes in the emission characteristics of the micropoints are a substantially unavoidable aspect of FEFPDs of the relevant type (e.g., due to effects of contamination of the micropoints over the lifetime of the display). Displays according to the invention can be relatively insensitive to such changes in the emission characteristics.

Optional provision of gate impedances can result in a structure wherein a given pixel can continue to operate even in the event of short circuit failure of one or more micropoints of the pixel, as will be discussed in more detail below. Briefly, introduction of gate impedances can significantly reduce the effect of an emitter/gate short circuit on pixel brightness if the gate impedance is substantially larger than the equivalent impedance in the emitter circuit.

A significant aspect of this disclosure is the recognition that capacitors can advantageously be used instead of some resistors in FPFEDs. As will be discussed in more detail below, substitution of capacitors for resistors necessitates some design changes, typically including increase of the number of micropoints/pixel by about a factor of two. However, the substitution can substantially improve manufacturability, since it is relatively easy to produce monolithic capacitors of the required capacitance values, whereas it is frequently difficult to reproducibly manufacture monolithic resistors of the required high resistances. Furthermore, use of capacitive impedances can result in FPFED designs that are relatively insensitive to temperature variations, since high value resistors typically introduce significant temperature dependencies, whereas capacitors typically are relatively temperature insensitive. In a FPFED according to the invention with capacitive impedances the emission from the two micropoints of a coupled pair of micropoints is typically not equal, as will be appreciated by those skilled in the art.

It will be appreciated that flat panel displays of the relevant type generally are highly symmetrical structures, such that features that are described as pertaining to a given intersection region (corresponding to a "pixel") pertain to all, or at least substantially all, intersection regions.

The invention can be embodied in a variety of different designs, some of which will be described in detail below. Furthermore, novel optional features can be added, to achieve further improvements. For instance, by means of a photoconductive element self-regulation can be improved, provided the element is provided such that it serves to reduce the voltage between micropoints and gate if the brightness of a pixel increases. Provision of a photoconductive element also reduces the sensitivity of the pixel brightness to the exact values of resistances associated with a pixel. This is an advantageous feature for the previously referred to reason. Gate impedances can be added to limit power consumption and reduce the effect of a short circuit between a micropoint and the gate electrode. An additional (auxiliary) gate electrode can be added to capture ions that are created in the space between the anode and the auxiliary gate electrode. Such an additional electrode can advantageously be used to monitor the pressure in the cell, or to focus or bend the electrons that are travelling from the micropoint emitter to the anode. Gettering means can be incorporated into the cell, such that a low pressure environment can be maintained. Such gettering means exemplarily comprise micropoint emitters (and/or gate electrodes) made of a gettering metal, e.g., Ta, Ti, Nb, or Zr.

DETAILED DESCRIPTION OF SOME PREFERRED EMBODIMENTS

Figure 1:
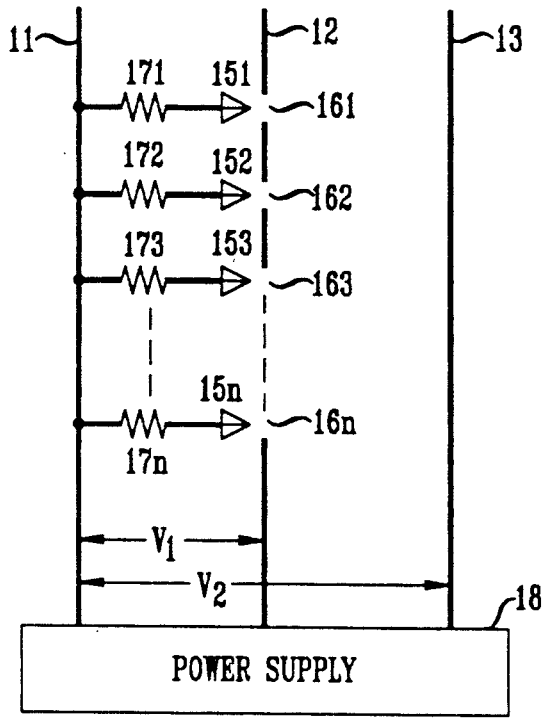
FIG. 1 (PRIOR ART)
FIGS. 1 and 2 schematically depict relevant aspects of a prior art FPFED and of an exemplary FPFED according to the invention, respectively.

FIG. 1 schematically depicts a circuit diagram representative of the prior art. It will be understood that the figure pertains to a single intersection region. Numeral 11 refers to the cathode electrode, 12 to the gate electrode, and 13 to the anode. Micropoints 151, 152, . . . **15*n* are connected to the cathode electrode by means that comprise resistive elements 171, 172, . . . 17*n*, and face apertures 161, 162, . . . 16*n* in the gate electrode. Power supply 18 is adapted for applying a voltage $V_1$ between electrodes 11 and 12, and a voltage $V_2$ between 11 and 13**.

Figure 2:
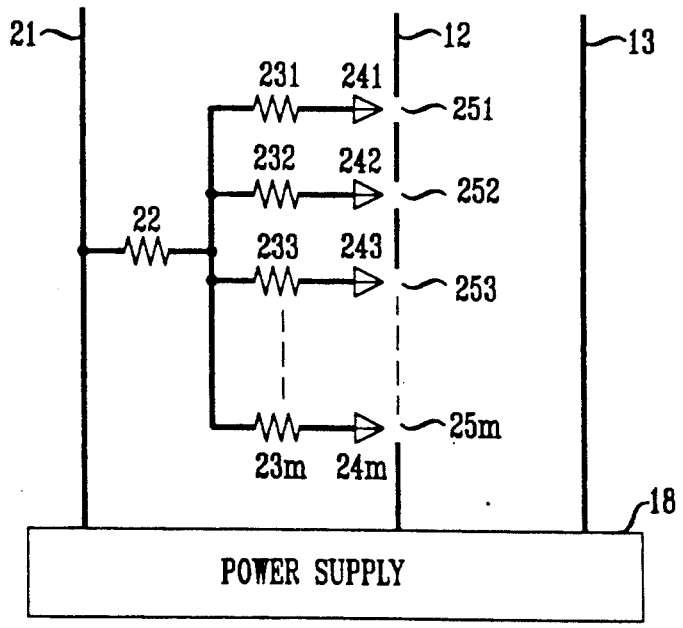

The corresponding portion of an exemplary display according to the invention is schematically shown in FIG. 2, wherein 21 refers to the cathode electrode, 231 . . . **23*m* to resistive elements, 241 . . . 24*m* to the micropoints, and 251 . . . 25*m* to the apertures in the gate electrode 12. Resistive element 22 connects the micropoint assembly to the cathode electrode 21**, and carries the total current to all the micropoints in the given intersection region.

Figure 12:
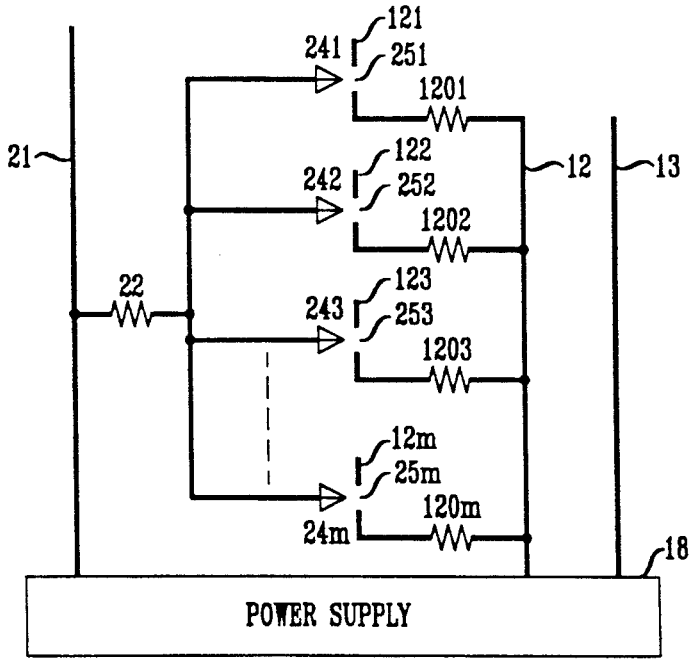
FIG. 12 shows schematically a further exemplary embodiment of the invention.

A further embodiment of the invention is schematically depicted in FIG. 12, wherein gate impedances **120*i* ($i=1, \ldots m$) are added, and impedances 23*i* (of FIG. 2) are omitted. It will be appreciated that the embodiment of FIG. 12 comprises separate gate electrodes 12*i* rather than a unitary gate electrode (e.g., 12 of FIG. 2**).

Figure 3:
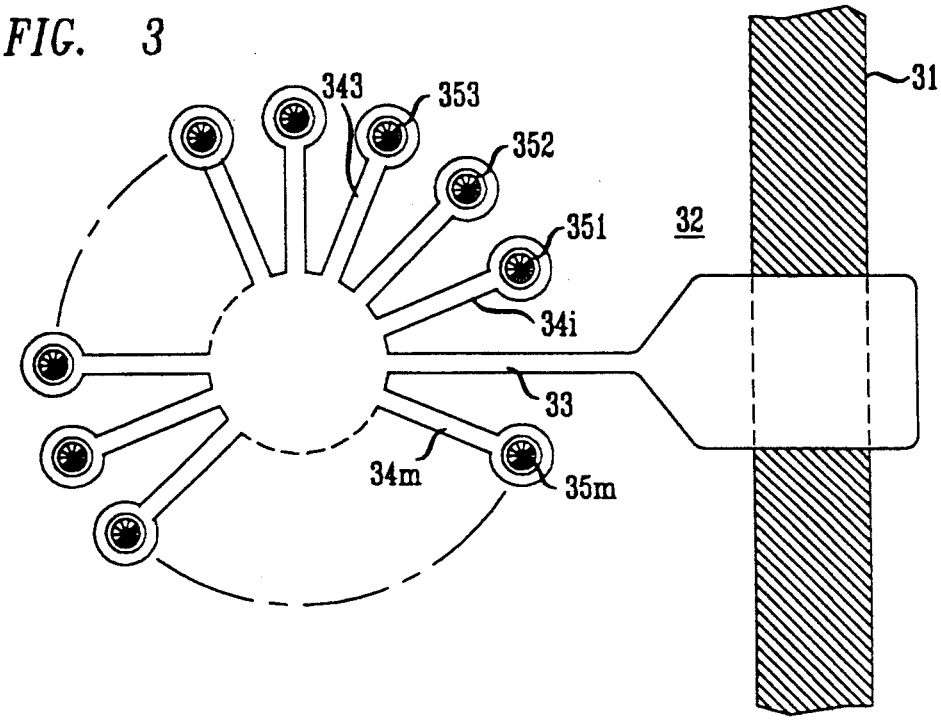
FIGS. 3 and 4 schematically show exemplary cathode structures.

FIG. 3 schematically depicts a relevant portion of a cathode electrode in top view. Numeral 31 refers to the highly conductive (e.g., Al) portion of the cathode electrode, to be referred to as a "buss" (exemplarily a column buss). The buss makes electrical contact with patterned resistive (e.g., resistivity of order $10^5\Omega$-cm) material 32 (e.g., indium-tin-oxide, or substantially undoped Si). The patterned material comprises constricted portion 33 which substantially corresponds to resistive element 22 of FIG. 2. The patterned material may also comprise a multiplicity of constricted portions **341–34*m*($m \sim 100$which substantially correspond to resistive elements 231–23*m* of FIG. 2. On the distal ends of the radiating resistive elements are located micropoints 351–35*m*, which make electrical contact with their associated resistive elements. Exemplarily, the radius of the radiating pattern is about 50 $\mu$m, and the spacing between adjacent micropoints is about 5 $\mu$m. Furthermore, resistive element 33 exemplarily has a resistance in the range $3\text{–}30\times10^6\Omega$, e.g., about $10\times10^6\Omega$, and each resistive element 34*i* exemplarily has a resistance in the range $0.3\text{–}3\times10^9\Omega$, e.g., about $10^9\Omega$. Those skilled in the art will recognize that the presence of resistors 34***i* is not essential, and that a structure as described can be readily produced by conventional techniques, including lithography and etching. Furthermore, it will be apparent that the depicted arrangement is exemplary only, and that other arrangements are possible. For instance, it might be desirable to distribute the micropoint emitters more uniformly over the pixel area and/or to have a pixel of other than circular shape.

Figure 4:
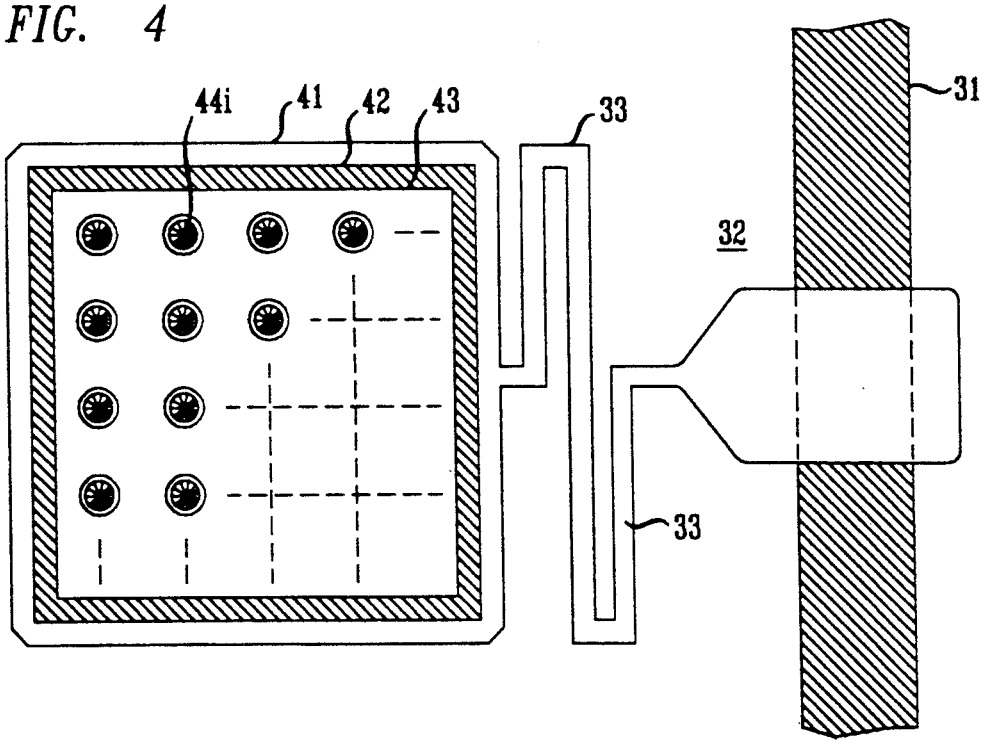

Resistive elements that correspond to resistors 231–23*m* of FIG. 2 need not be elongate elements of the type shown in FIG. 3, but instead can be elements of the type disclosed in the '916 patent. Such an embodiment is schematically shown in FIG. 4, wherein on extended portion 41 of the patterned resistive material 32 is optional highly conductive layer 42 (which can serve to equalize the resistance for each micropoint emitter 44*i*; i=1 . . . m), with highly resistive layer 43 on 42 or 41, as the case may be. Layer 43 corresponds to layer 24 of the '916 patent, and can have properties and composition as described in that patent.

As is conventional, on the cathode electrode means is deposited dielectric material (e.g., $SiO_2$) that serves as spacer material that electrically isolates the gate electrode means from the cathode electrode means. See layer 8 of the '916 patent. Over the spacer layer is deposited conductive material which, after patterning, serves as the gate electrode. See layer 10 of the '916 patent. By means of conventional lithography and etching, apertures are formed through the gate layer and the spacer layer in the intersection regions, and the micropoints are formed by deposition through the apertures, all in a known manner.

Figure 5:
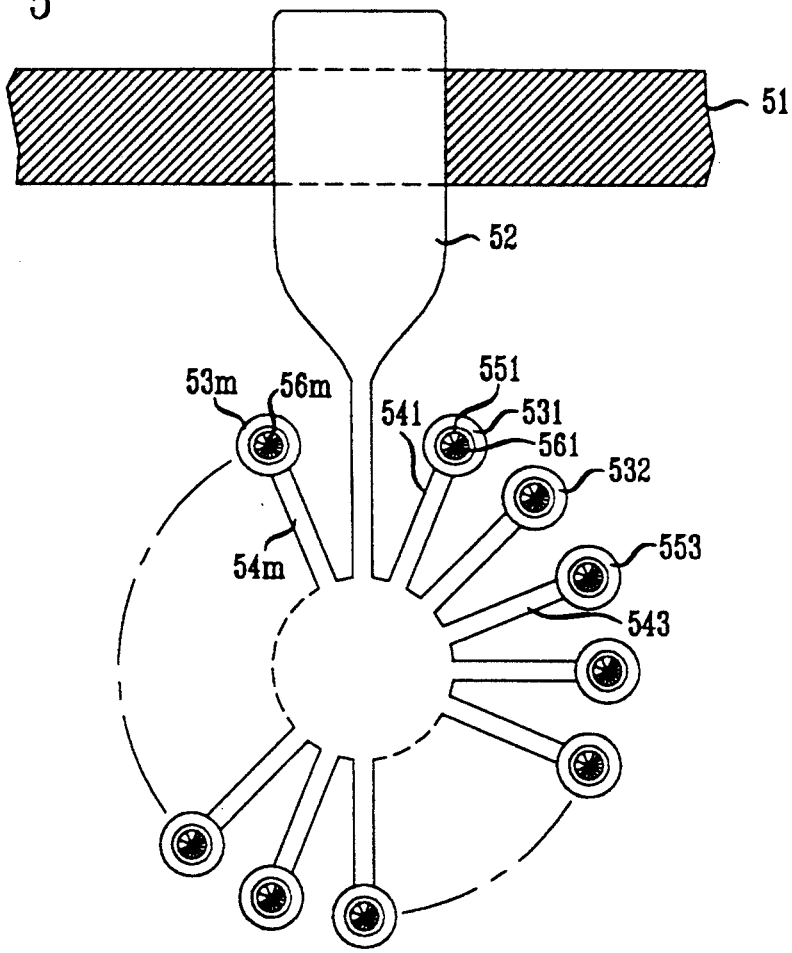
FIG. 5 shows schematically an exemplary gate structure.

In order to avoid the loss of a pixel in the event of shorting of one or more micropoints to the respective gate electrode, it is desirable to provide gate impedances. An exemplary arrangement, complementary to the cathode structure of FIG. 3 and utilizing gate resistors, is schematically depicted in FIG. 5. Numeral 51 refers to the buss (exemplarily a row buss), and 52 to patterned high resistivity material, substantially as discussed, all deposited on a dielectric spacer layer. Rings 531 . . . 53*m* consist of high conductivity material, typically the same material as the micropoints (e.g., Mo). "Spokes" 541–54*m* are the gate resistors. Numerals 551 . . . 55*m* refer to the apertures in the gate structure, and 561 . . . 56*m* to the tips of the micropoints. It will be appreciated that it is not a requirement that a separate impedance (e.g., resistor) be associated with each micropoint, although it will typically be desirable to limit the number of micropoints per impedance to a number less than or equal to five, e.g., three. Gate impedances advantageously have values that are much larger (exemplarily by at least a factor of ten times the number of micropoints/pixel) than the value of the impedance associated with the cathode buss-to-micropoint connection (e.g., resistor 22).

The current that flows between the anode and an optional auxiliary gate electrode that is formed on the already described gate electrode assembly, can be used to monitor the vacuum in the display cell.

Figure 6:
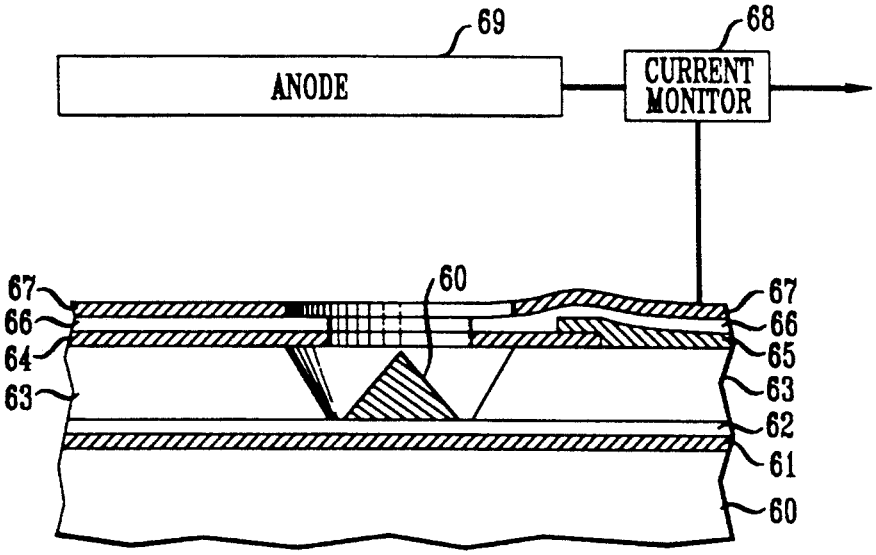
FIG. 6 illustrates the layer structure in an exemplary FPFED with gate resistors and pressure monitoring means.

FIG. 6 schematically depicts in cross section the layer structure associated with a given micropoint. On substrate 60 is provided conductive layer 61 (which connects the micropoint to the cathode buss via an appropriate impedance). Numeral 62 refers to a resistive layer (corresponding to 24 of the '916 patent), 63 to the spacer layer, and 64 to the gate electrode (corresponding to ring 53*i* of FIG. 5). Numeral 65 refers to the gate resistor (corresponding to 54*i* of FIG. 5), 66 to an insulating layer (e.g., 0.5 μm $SiO_2$), and 67 to the auxiliary gate electrode (e.g., Mo). Means 68 are provided to measure the current between anode 69 and the auxiliary gate electrode. Means 68 optionally provide an output when the current exceeds a predetermined value, indicating a pressure increase in the cell above a predetermined level.

Current monitoring can be done by known means, e.g., by means of an IC amplifier and appropriate conventional read-out means. The above referred to output of means 68 can serve to trigger the firing of gettering means, to be discussed below.

As those skilled in the art will appreciate, it is necessary to maintain a high vacuum (typically of order $10^{-7}$ Torr) within the FPFED for an extended period, typically years. On the other hand, it is known that electron bombardment of anode materials (e.g., phosphors) results in outgassing, and consequently in a build-up of gas in the cell. In order to prevent or delay unacceptable build-up, and thus to extend the useful life of an FPFED, it is desirable to provide gettering means within the cell. A preferred embodiment of the instant invention comprises gettering means that can be activated from without the cell, whenever indicated by, e.g., a deterioration of the operating characteristics of the display or by an increase in the auxiliary gate/anode current. Exemplarily the gettering means comprise micropoints that consist of one of the known getter metals, exemplarily Ta, Ti, Nb or Zr. It is contemplated that the great majority (>90 or even 99%) of micropoints consists of conventional emitter material, typically Mo. It is also contemplated that circuitry is provided which makes it possible to activate a batch (e.g., 20%) of the getter micropoints without activation of the other micropoints. By "activating" is meant causing sufficient field emission from a getter micropoint such that getter metal is evaporated from the micropoint or the associated gate electrode. This will typically require application of a voltage $V_3 > V_1$ between the getter micropoints and the gate, and a low resistance path between power supply and getter micropoints. The evaporated getter metal is deposited, inter alia, on the anode. For this reason it is desirable to limit the amount of evaporated getter metal as much as possible, consistent with the objective of gas pressure maintenance. Exemplarily, the getter micropoints are arranged in separate rows (or columns) between the pixel rows (or columns), with each row (or column) separately addressable. Alternatively, the getter micropoints are arranged around the periphery of the display.

Figure 7:
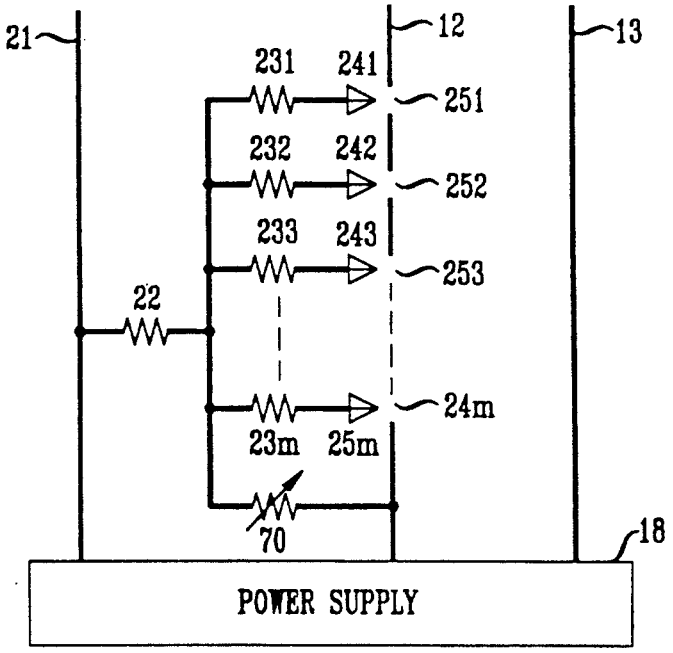
FIGS. 7 and 8 schematically show relative aspects of inventive FPFEDs that comprise a photoconductive element.
Figure 8:
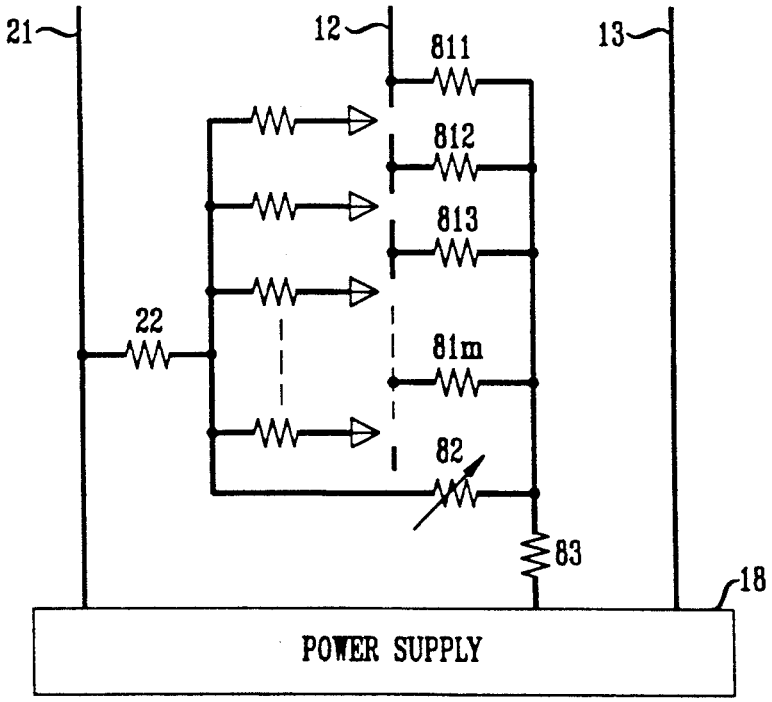

A further exemplary embodiment of the invention comprises photoconductive elements that serve to further improve self regulation of pixel brightness. Typically, a photoconductive element is associated with each pixel, positioned such that a given element substantially receives only light from the associated pixel. Exemplarily, the photoconductive element is connected as shown schematically in FIG. 7, wherein the element is represented by variable resistor 70. An alternative connection scheme is illustrated in FIG. 8, wherein 811 . . . 81*m* are gate resistors, 82 is the photoconductive element, and 83 is an optional current limiting resistor. The photoconductive elements can be formed by a conventional technique (e.g., vapor deposition, photolithography and etching) using known photoconductive materials, e.g., SbS, PbO, ZnO, CdS, CdSe, or PbS.

As disclosed above, we have discovered that at least some of the resistors of a FPFED can be advantageously replaced by capacitors, resulting in a more readily manufacturable display. Substitution is relatively straightforward, although generally not one-for-one, as will be now illustrated. Of course, if capacitors are to be used then at least $V_1$ will be an alternating voltage. By "alternating voltage" we mean herein a voltage that goes both above and below an appropriate level that is not necessarily zero. An alternating voltage typically will not be sinusoidal, and exemplarily comprises triangular pulses.

Figure 9:
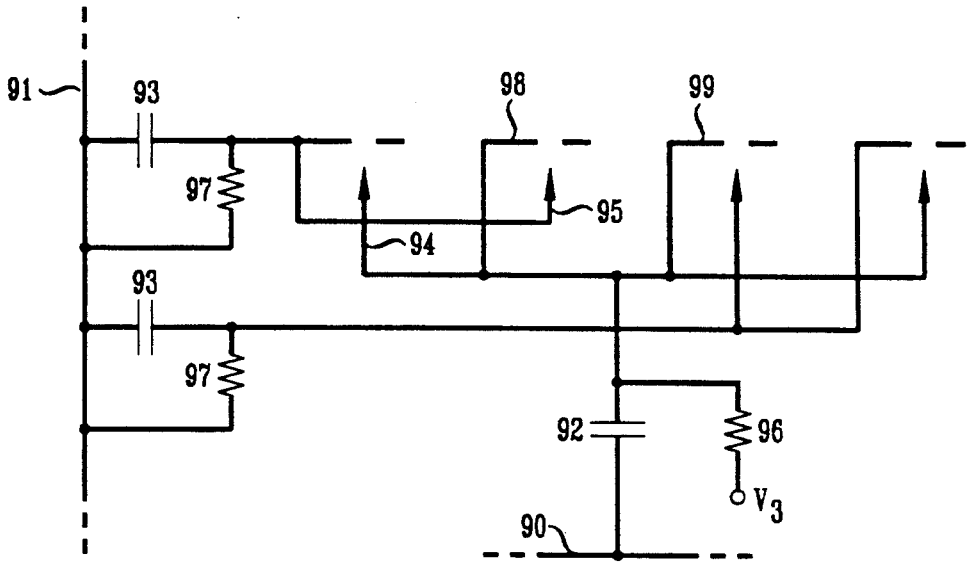
FIG. 9 illustrates the structure of an exemplary inventive FPFED that utilizes capacitors as impedance elements.

FIG. 9 schematically depicts the electrical connections associated with a portion of an intersection region (typically an intersection region comprises 20 or more micropoints per color). Numeral 90 refers to the cathode buss (e.g., row buss) and 91 to the gate buss (e.g., column buss). The impedance that carries the total current to all the micropoints comprises capacitor 92 (exemplarily of order 1 pF) and resistor 96. (Resistor 96 can optionally be connected to buss 90 or to an appropriate constant voltage $V_3$.) The gate impedances comprise capacitors 93 (exemplarily about 0.01 pF) and (optional) resistors 97. Numerals 94 and 95 refer to micropoints, and 98 and 99 to the associated gate electrodes. Advantageously (for reason of ease of manufacture) the resistive elements are non-linear resistors (varistors) which have very high resistance (e.g., $>10^8\Omega$ for 96) for voltages below some predetermined value (e.g., 30 volt), and relatively low resistance (e.g., $<10^7\Omega$ for 96) for voltages above that value, thus serving to clamp the voltage at the predetermined value. As those skilled in the art will recognize, applying properly phased ac signals to 90 and 91 can cause emission successively from 94 and 95, resulting in light emission from the anode. For some choices of impedances 96 and 97 it may be unnecessary to provide additional micropoints 95.

The design of FIG. 9 is appropriate for a display that is scanned row-by-row, and wherein all desired pixels in a given row are illuminated nearly simultaneously. The design can tolerate relatively large variations in the values of resistors 96 and 97, and thus is relatively easy to manufacture. This tolerance is due to the fact that these resistors only need to discharge their associated capacitors between frames. Thus, variations in resistor values by as much as a factor ten may be acceptable in at least some cases.

Figure 10:
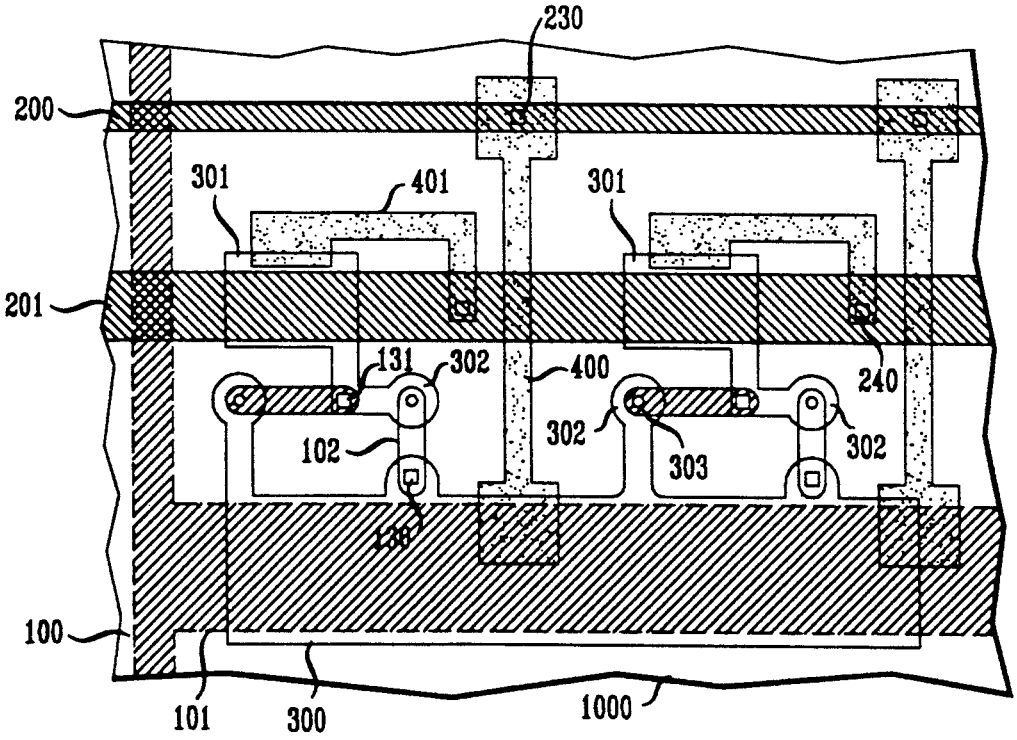
FIG. 10 schematically depicts the metal lay-out of a section of a FPFED of the type shown in FIG. 9.

FIG. 10 schematically depicts an exemplary implementation of a portion of a FPFED according to the invention, the portion corresponding substantially to FIG. 9. On an appropriately prepared substrate 1000 is deposited a first metal (e.g., Mo) layer that is patterned such that row buss 100, capacitor electrode 101, and conductor strips 102 remain. After deposition of an appropriate dielectric (e.g., 0.5 μm $SiO_2$) layer a second metal (e.g., Al, Cu) layer is deposited and patterned such that conductor 200 and column bus 201 remain. After deposition of another dielectric layer (e.g., 0.5 μm $SiO_2$) an amorphous Si layer is deposited and patterned by conventional means such that varistors 400 and 401 (corresponding to resistors 96 and 97 of FIG. 9, respectively) remain. After etching of the apertures through the dielectric to first metal strips 102 a patterned third metal (e.g., Mo) layer is formed by, e.g., a conventional lift-off technique. The pattern comprises capacitor counterelectrode 300 (forming together with 101 capacitor 92 of FIG. 9), capacitor counterelectrodes 301 (forming together with 201 capacitors 93 of FIG. 9) gate electrodes 302, and various conductor strips that are not specially identified. Formation of micropoints 303 is by a conventional technique.

As those skilled in the art will recognize, some vertical connections (vias) are also required. In particular, vias 130 and 131 between first metal conductor strips 102 and third metal are required (a via is schematically indicated in FIG. 10 by means of a small square), as are vias 230 between second metal and third metal, and vias 240 between second metal and varistors 401. The vias can be formed by conventional techniques.

Typical exemplary dimensions of the pattern of FIG. 10 are as follows: width of 201 and length of 301 each about 10 μm (resulting in a planar 10 μm×10 μm capacitor); width of 101 about 10 μm, with the length of 101 selected such that the desired capacitance results. The varistor values typically are selected such that, during emission from the relevant micropoints, only a small fraction (e.g., 10%) of the current flows through the varistors.

Figure 11:
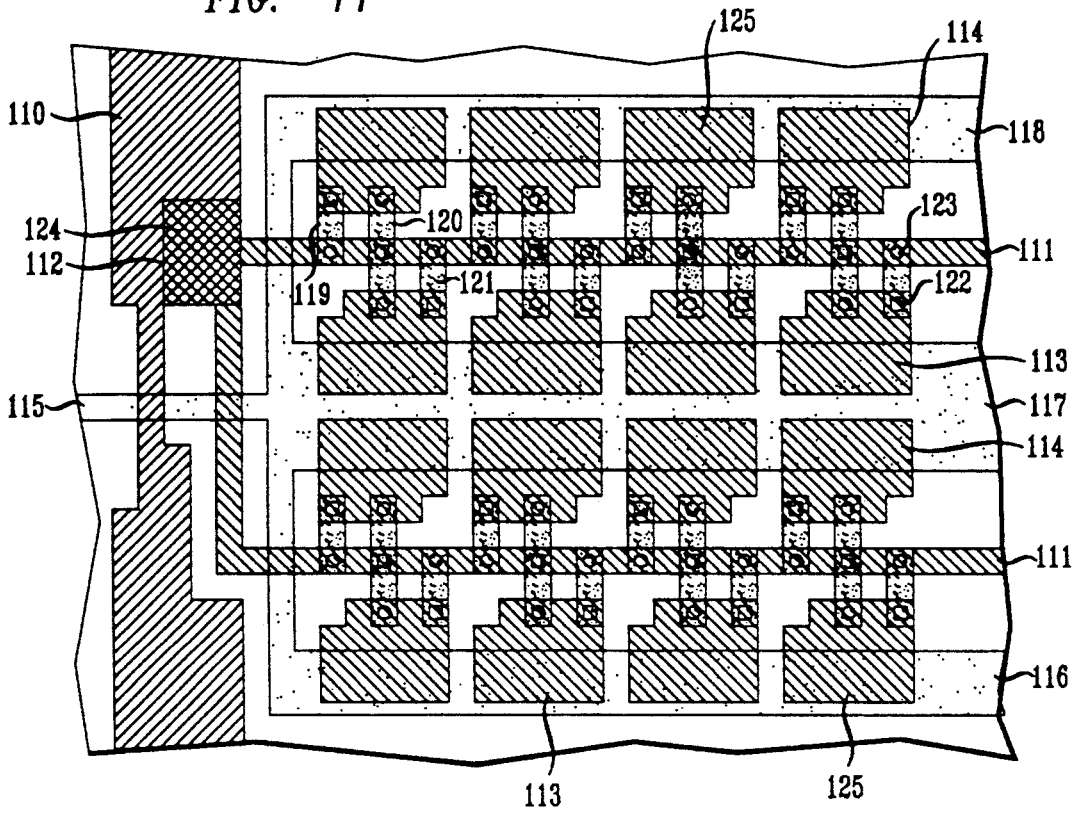
FIG. 11 schematically depicts the lay-out of the lithographic patterns for a portion of an exemplary cathode and gate structure according to the invention.

Example. The cathode structure of a FPFED according to the invention is made as follows. On a conventionally prepared glass substrate is deposited a 50 nm thick Cu layer. The layer is patterned such that column bus 110 of FIG. 11 remains. Next a 70 nm thick layer of (slightly Ta-rich) $Ta_2O_5$ is deposited, followed by deposition of a 50 nm thick layer of Mo. The Mo layer is patterned such that conductor lines 111, capacitor plates 112, 113 and 114 (all of FIG. 11) remain. This is followed by deposition of a 1.5 μm thick $SiO_2$ layer and a 200 nm Mo layer. The Mo layer is patterned such that row bus 115, capacitor strip plates 116, 117, 118, and conductor strips 119, 120 and 121 (all of FIG. 11) remain. In FIG. 11, vias between the two Mo layers are indicated by means of squares 122, and the micropoints (situated on the lower Mo layer) are indicated by circles 123. The vias and micropoints are formed by conventional means. The various layers are sputter deposited in conventional manner.

It will be appreciated the FIG. 11 schematically depicts only a small portion of the total cathode structure. The total exemplary structure comprises 256×256 pixels, each pixel having overall size 0.3×0.3 mm. Capacitor 124 of FIG. 11 corresponds to capacitor 92 of FIG. 9 and has a value of 1.6 pF, and capacitors 125 of FIG. 11 correspond to capacitors 93 of FIG. 9 and have a value of 0.01 pF. The dielectric of capacitor 124 is leaky so as to provide an effective parallel resistance that corresponds to resistor 96 of FIG. 9. The composition of the Ta-oxide layer is chosen such that the leakage resistance of 124 is about $0.67\times10^9\Omega$, providing an RC time constant of about $10^{-3}$ seconds. Those skilled in the art will recognize that the exemplary structure of FIG. 11 does not comprise resistors equivalent to optional resistors 97 of FIG. 9. The exemplary structure comprises 16 pairs of micropoints/pixel and color.

I claim:

1. An article comprising field emission cathodoluminescent display means comprising a) a multiplicity of cathode electrode means comprising i) a plurality of micropoint emitter means, and ii) impedance means for limiting a current associated with said micropoint emitter means;

b) a multiplicity of gate electrode means, arranged such that said cathode and gate electrode means form a matrix structure having columns and rows and a multiplicity of intersection regions, with a multiplicity of said micropoint emitter means being located in a given intersection region, said micropoint emitter means facing towards said gate electrode means, with substantially each of said micropoint emitter means in the given intersection region being associated an aperture through said gate electrode means;

c) anode means comprising material capable of cathodoluminescence, said anode means positioned such that electrons that are emitted from the micropoint emitter means in the given intersection region can impinge on the anode means; and d) means for applying a first voltage $V_1$ between a predetermined cathode electrode means and a predetermined gate electrode means, and means for applying a second voltage $V_2$ between the predetermined cathode electrode means and the anode means; characterized in that e) said impedance means comprise first impedance means that carry substantially all of the current associated with substantially all the micropoint emitter means in one or more intersection regions including the given intersection region, but including fewer than all of the intersection regions in a column or row.

2. An article according to claim 1, wherein said first impedance means comprise capacitor means, and wherein at least $V_1$ is an alternating voltage.

3. An article according to claim 1, wherein said first impedance means carry substantially all of the currents associated with substantially all the micropoint emitter means in fewer than five of the intersection regions.

4. An article according to claim 3, wherein said first impedance carries substantially only the current associated with the micropoint emitter means in the given intersection region.

5. An article according to claim 1, wherein said impedance means further comprise second impedance means comprising a multiplicity of impedances, with a given impedance of said multiplicity of impedances carrying the current to one or more, but fewer than all, micropoint emitter means of the given intersection region.

6. An article according to claim 5, wherein said given impedance comprises capacitor means.

7. An article according to claim 6, wherein said first impedance means also comprise capacitor means.

8. An article according to claim 1, wherein said multiplicity of gate electrode means comprises a multiplicity of parallel gate electrodes, with a given gate electrode comprising a unitary conductor body.

9. An article according to claim 1, wherein the gate electrode means associated with the given intersection region comprise a multiplicity of gate electrodes, associated with a given gate electrode being one or more, but fewer than all, micropoint emitters of the given intersection region, and wherein associated with said given gate electrode are gate impedance means of impedance value $Z_g$, said impedance means adapted for carrying a current from said gate electrode to said means for applying a first and/or second voltage.

10. An article according to claim 9, wherein associated with the micropoint emitters associated with the given gate electrode is an equivalent emitter impedance $Z_e$, with $Z_g > Z_e$.

11. An article according to claim 10, where $Z_g \geqq 10Z_e$.

12. An article according to claim 2, wherein the given intersection region comprises at least one coupled pair of micropoint emitters, the coupling being such that the voltage between one of the micropoint emitters and the associated gate electrode means is positive during at least a part of a cycle of alternating voltage $V_1$, and the voltage between the other of the micropoint emitters and said associated gate electrode means is positive during at least a part of the remainder of the cycle of $V_1$.

13. An article according to claim 1, further comprising a photoconductive element that is associated with the given intersection region and provides a current path between the cathode electrode means and the gate electrode means whose value of resistance is a function of the light emitted from a region of the anode means associated with the given intersection region.

14. An article according to claim 1, further comprising auxiliary gate electrode means that are spaced from said gate electrode means and are located between said gate electrode means and the anode means.

15. An article according to claim 14, wherein an electrically conductive path is provided between said auxiliary gate electrode means and the anode means, said path comprising means adapted for indicating a level of current flowing in said path.

16. An article according to claim 1, comprising one or more bodies consisting of a metal selected from the group consisting of Ta, Ti, Nb and Zr, and further comprising means for heating at least one of said bodies such that at least some of the metal of said body is evaporated.

17. An article according to claim 16, wherein said micropoint emitters consist substantially of Mo, and wherein said metal bodies have substantially the same shape as said Mo micropoint emitters.

18. An article according to claim 15, further comprising one or more bodies consisting of a metal selected from the group consisting of Ta, Ti, Nb and Zr, and still further comprising means for heating at least one of said bodies in response to a level of current in said path that is in excess of a predetermined level of current, said heating carried out such that at least some of the metal of said body is vaporized.

19. An article according to claim 2, wherein said first impedance means further comprise resistor means in parallel with said capacitor means, the resistor means selected such that during emission from the micropoint emitter means in the given intersection region at most 10% of the total current to said micropoint emitter means flows through said resistor means.

20. An article according to claim 19, wherein said resistor means comprise a non-linear resistor whose value of resistance is a function of the voltage across the resistor.

21. An article comprising field emission cathodoluminescent display means comprising a) a multiplicity of cathode electrode means comprising i) a plurality of micropoint emitter means, and ii) impedance means for limiting a current associated with said micropoint emitter means;

b) a multiplicity of gate electrode means, arranged such that said cathode and gate electrode means form a matrix structure having columns and rows and a multiplicity of intersection regions, with a multiplicity of said micropoint emitter means being located in a given intersection region, said micropoint emitter means facing towards said gate electrode means, with substantially each of said micropoint emitter means in the given intersection region being associated an aperture through said gate electrode means;

c) anode means comprising material capable of cathodoluminescence, said anode means positioned such that electrons that are emitted from the micropoint emitter means in the given intersection region can impinge on the anode means; and d) means for applying a first voltage $V_1$ between a predetermined cathode electrode means and a predetermined gate electrode means, and means for applying a second $V_2$ voltage between the predetermined cathode electrode means and the anode means; characterized in that e) said impedance means comprise capacitor means, and wherein at least $V_1$ is an alternating voltage.

22. An article according to claim 21, wherein said impedance means comprise first impedance means that carry substantially all of the current associated with substantially all the micropoint emitter means in one or more intersection regions including the given intersection region, but including fewer than all of the intersection regions in a column or row.

23. An article according to claim 22, wherein said first impedance means comprise capacitor means.

* * * * *